US010305219B2

(12) United States Patent
Zebhauser et al.

(10) Patent No.: US 10,305,219 B2
(45) Date of Patent: May 28, 2019

(54) PLUG CONNECTOR WITH DAMPING ELEMENT

(71) Applicant: ROSENBERGER HOCHFREQUENZTECHNIK GMBH & CO. KG, Fridolfing (DE)

(72) Inventors: Martin Zebhauser, Laufen (DE); Norbert Praschberger, Traunstein (DE); Paul Teichmann, Merseburg (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/545,897

(22) PCT Filed: Feb. 4, 2016

(86) PCT No.: PCT/EP2016/000184
§ 371 (c)(1),
(2) Date: Jul. 24, 2017

(87) PCT Pub. No.: WO2016/131526
PCT Pub. Date: Aug. 25, 2016

(65) Prior Publication Data

US 2018/0261954 A1 Sep. 13, 2018

(30) Foreign Application Priority Data

Feb. 19, 2015 (DE) ..... 20 2015 001 331 U

(51) Int. Cl.
*H01R 9/05* (2006.01)
*H01R 13/53* (2006.01)
(Continued)

(52) U.S. Cl.
CPC ..... *H01R 13/53* (2013.01); *H01R 13/5025* (2013.01); *H01R 24/38* (2013.01); *H01R 2103/00* (2013.01)

(58) Field of Classification Search
CPC ..... H01R 9/05
(Continued)

(56) References Cited

U.S. PATENT DOCUMENTS 3,017,597 A 1/1962 Nava
3,976,352 A * 8/1976 Spinner ..... H01R 24/40 333/260
(Continued)

FOREIGN PATENT DOCUMENTS

CN 103493306 A 1/2014
DE 69803920 T2 9/2002
(Continued)

*Primary Examiner* — Neil Abrams
(74) *Attorney, Agent, or Firm* — DeLio, Peterson & Curcio, LLC; Robert Curcio

(57) ABSTRACT

A high current connector, having an inner conductor contact for carrying current, an outer conductor part, and an isolator part which keeps the inner conductor contact spaced apart from the outer conductor part, wherein a resiliently compressible damping element is provided on the connector in such a way that, when a complementary counterpart connector is inserted into the connector, the element is resiliently compressible in an insertion direction and the mobility of the isolator part is reduced with respect to the inner conductor contact and/or with respect to the outer conductor part. This feature is used to eliminate play between the affected parts to lessen material wear.

20 Claims, 4 Drawing Sheets

(51) Int. Cl.
*H01R 24/38* (2011.01)
*H01R 13/502* (2006.01)
*H01R 103/00* (2006.01)

(58) Field of Classification Search
USPC ..... 439/578, 582, 675, 382, 383
See application file for complete search history.

(56) References Cited

U.S. PATENT DOCUMENTS 4,451,103 A * 5/1984 Buresh ..... H01R 24/50 439/382
4,501,462 A * 2/1985 Fidi ..... H04R 1/083 439/382
5,588,852 A * 12/1996 Puerner ..... H01R 13/44 439/135
6,450,829 B1 * 9/2002 Weisz-Margulescu ..... H01R 13/424 439/263
6,953,371 B2 * 10/2005 Baker ..... H01R 9/0515 439/582
7,309,247 B1 * 12/2007 Keating ..... H01R 13/5219 439/271
7,452,234 B2 * 11/2008 Ma ..... H01R 13/6582 439/382
7,815,461 B2 * 10/2010 Oka ..... H01R 13/533 439/382
8,668,188 B2 * 3/2014 Gnateski ..... F16F 1/028 267/136
8,814,600 B2 * 8/2014 Watanabe ..... H01R 13/7033 439/620.09
8,858,258 B2 * 10/2014 Stokowski ..... H01R 13/42 439/582
9,166,329 B2 * 10/2015 Eckel ..... H01R 13/5219
9,419,374 B2 * 8/2016 Umbach ..... H01R 13/622
2003/0203674 A1 10/2003 Baker
2006/0050853 A1 3/2006 Hansen et al.
2015/0038009 A1 2/2015 Gibson et al.

FOREIGN PATENT DOCUMENTS

DE 10140177 A1 4/2003
DE 102009043516 A1 4/2011
DE 102011004347 A1 8/2012
DE 202014006815 U1 9/2014
FR 2269806 A1 11/1975
JP 2009252682 A 10/2009
JP 2014123446 A 7/2014

* cited by examiner

PLUG CONNECTOR WITH DAMPING ELEMENT

BACKGROUND OF THE INVENTION

1. Field of the Invention

The invention relates to a plug connector, in particular a high-current plug connector, comprising an inner conductor contact, an outer conductor part and an insulating part which keeps the inner conductor contact spaced apart from the outer conductor part.

While the inner conductor contact is intended to carry current, the outer conductor part can be designed in the form of a housing, for example an outer conductor housing and/or can be earthed and thus shield the inner conductor. Such a coaxial plug connector can be coupled to a coaxial cable, wherein the outer conductor of the coaxial cable makes electrical contact with the outer conductor part of the plug connector and an inner conductor of the coaxial cable makes electrical contact with the inner conductor contact of the plug connector.

2. Description of Related Art

Plug connectors are used generally for the detachable connection of electrical cables in order, when connected, to transmit current and/or electrical signals. A first plug connector in the form of a socket part is thereby coupled with a second plug connector in the form of a plug part to form a plug connection. High current plug connectors are used to transmit high electrical currents, for example with a current strength of more than 50 A or 100 A, and are for example used in motor vehicles with electric or hybrid drives. The inner conductor contact of the mating plug connector can thereby have one or more contact pins projecting in the insertion direction S which are plugged, in the insertion direction, into a receiving opening of the plug connector. The inner conductor contact of the socket part is located in the receiving opening.

In order to prevent the inner conductor contact from being able to come into electrical contact with the outer conductor part, the inner conductor contact is generally held by an insulating part made of a non-conductive material such as plastic, wherein the insulating part is arranged between the inner conductor contact and the outer conductor part. When assembling the plug connector, the insulating part is first attached to the inner conductor contact, for example by means of a snap-locking connection or other form- or force-locking connection, and the assembly consisting of insulating part and inner conductor contact is then fixed to the outer conductor part, again for example by means of a snap-locking connection or other form- or force-locking connection.

However, it has been found that a plug connector structured in this way is susceptible to increased wear if it is subjected to high mechanical stresses. For this reason, conventional high-current plug connectors generally require maintenance, and components affected by wear such as inner conductor contacts or insulating parts generally need to be replaced.

SUMMARY OF THE INVENTION

In view of the problems described, it is the object of the present invention to provide a plug connector suitable for the transmission of high currents which is also subject to as little wear as possible even under high mechanical stresses such as powerful vibrations, and in this way to increase the durability of high-current plug connectors.

This problem is solved through a plug connector with the features of the independent claims. Advantageous further developments of the invention are described in the dependent claims.

The above and other objects, which will be apparent to those skilled in the art, are achieved in the present invention which is directed to a plug connector, comprising an inner conductor contact for carrying current, an outer conductor part and an insulating part which keeps the inner conductor contact spaced apart from the outer conductor part, wherein a resiliently compressible damping element is provided on the plug connector such that, when a complementary mating plug connector is plugged into the plug connector in an insertion direction (S), it is resiliently compressible, such that, when the mating plug connector is plugged in, the damping element directly or indirectly applies pressure in the insertion direction (S) on the inner conductor contact and/or on the insulating part and thereby reduces a movability of the insulating part relative to the inner conductor contact and/or relative to the outer conductor part.

When the mating plug connector is plugged in, the damping element indirectly applies pressure in the insertion direction (S) on the inner conductor contact and directly applies pressure in the insertion direction (S) on the insulating part.

The plug connector includes axial play between the inner conductor contact and the insulating part and/or between the insulating part and the outer conductor part, wherein at least the play between the inner conductor contact and the insulating part and also the play between the insulating part and the outer conductor part can be reduced or eliminated through application of pressure on the damping element in the insertion direction (S).

The axial material thickness of the damping element may be variable, and wherein a section of greater material thickness may be provided for the application of pressure on the inner conductor contact and a section of lesser material thickness for the application of pressure on the insulating part.

The damping element may form a front boundary surface of the plug connector which faces the mating plug connector when the latter is plugged in.

The damping element surrounds, in an annular manner, an insertion opening of the plug connector provided for insertion of a contact element of the mating plug connector.

A sliding element is included on the side of the damping element facing away from the mating plug connector when plugging in which is arranged so as to be axially displaceable along a guide of the plug connector and with a rear axial end which lies against the inner conductor contact. The sliding element is formed of a rigid, preferably at least in sections annular plastics body, on the front end of which the damping element is sprayed on. The sliding element may be, at least in sections, arranged in an at least in sections circular annular guide groove of the insulating part, the floor of which is formed by the inner conductor contact.

The resiliently compressible damping element may be arranged between the insulating part and the outer conductor part, and when plugging in the mating plug connector is compressible in that the insulating part is pressed in the direction of the outer conductor part. The damping element may have a substantially planar form with preferably roughly round contour and acts between a substantially flat contact surface of the outer conductor part and a counter pressure surface of the insulating part.

The dimension of the damping element in the insertion direction (S) is variable, wherein a central region of the damping element is thicker than an edge region of the damping element.

The plug connector may be, in a second embodiment, an angle connector, in which a main axis (H) of the inner conductor contact and/or of the insulating part runs transversely, approximately perpendicular to the insertion direction (S), wherein the inner conductor contact and/or the insulating part is, at least in sections, deflected at least in sections relative to the main axis (H) by the damping element and can be deflected back through the plugging-in of the mating plug connector with compression of the damping element.

In a second aspect, the present invention is directed to a plug connector arrangement with a plug connector comprising: an inner conductor contact for carrying current, an outer conductor part and an insulating part which keeps the inner conductor contact spaced apart from the outer conductor part, wherein a resiliently compressible damping element is provided on the plug connector such that, when a complementary mating plug connector is plugged into the plug connector in an insertion direction (S), it is resiliently compressible, such that, when the mating plug connector is plugged in, the damping element directly or indirectly applies pressure in the insertion direction (S) on the inner conductor contact and/or on the insulating part and thereby reduces a movability of the insulating part relative to the inner conductor contact and/or relative to the outer conductor part; and a complementary mating plug connector configured such that when the complementary mating plug connector is plugged into the plug connector the damping element of the plug connector is compressed and a movability of the insulating part relative to the inner conductor contact and/or relative to the outer conductor part is thereby reduced.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
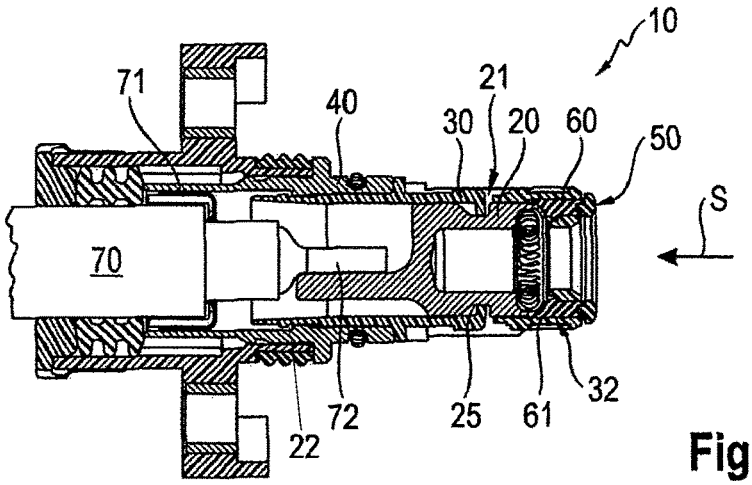
FIG. 1 shows a first embodiment of a plug connector according to the invention in a longitudinal sectional view.

In describing the preferred embodiment of the present invention, reference will be made herein to FIGS. 1-8 of the drawings in which like numerals refer to like features of the invention.

In a plug connector according to the invention, a resiliently compressible damping element is provided such that, when a complementary mating plug connector is plugged into the plug connector in an insertion direction, it is resiliently compressed and a movability of the insulating part relative to the inner conductor contact and/or relative to the outer conductor part is thereby reduced. In other words, the damping element, for example in the form of a resiliently compressible soft component, is provided on the plug connector such that it is compressed when pressure is applied to the plug-side end of the plug connector, and the inner conductor contact is pressed in a cushioned manner against the insulating part and/or the insulating part is pressed in a cushioned manner against the outer conductor part.

The invention is based on the knowledge that, in convention plug connectors, as a result of the manufacturing process there is generally a significant axial play between the inner conductor contact and the insulating part or between the insulating part and the outer conductor part. This axial play can lead to considerable relative movements of the insulating part relative to the outer conductor part or relative to the inner conductor contact under mechanical stresses such as vibrations, resulting in the increased wear on the plug connector described above.

Attempts have already been made to restrict this movability of the insulating part in that the connection between the insulating part and the inner conductor contact and/or the outer conductor part is made more stable or stiffer. However, a very stiff and immovable connection between the insulating part and the inner conductor contact and/or the outer conductor part makes it difficult to install the plug connector quickly and simply. In contrast, the insulating part of the plug connector according to the invention can (before coupling with the mating plug connector) exhibit a specified axial movability relative to the outer conductor part and/or relative to the inner conductor contact, so that a particularly simple and quick installation of the plug connector is possible. According to the invention, the movability of the insulating part which causes the observed wear is only reduced or completely eliminated through the coupling of the mating plug connector with the plug connector and the associated application of axial pressure on the plug connector. According to the invention this is achieved in that a resilient damping element is provided on the plug connector such that, when the mating plug connector is plugged in, it is compressed in the insertion direction as a result of the pressure thereby applied, thus pressing together the insulating part, the inner conductor contact and/or the outer conductor part in an axial direction.

The plug connector according to the invention can therefore be installed quickly and simply and at the same time guarantees, when plugged together, a high stability and a good axial fixing of the insulating part between the inner conductor contact and the outer conductor part, so that vibrations transmitted from the outer conductor part cannot lead to relative movements between the individual plug connector components.

In a preferred embodiment of the invention, when plugging in the mating plug connector the damping element indirectly or directly applies pressure in the insertion direction on the inner conductor contact and/or pressure on the insulating part, so that the inner conductor part is forced in the direction of the insulating part and/or the insulating part is forced in the direction of the outer conductor part. As a result of the plugging action of the mating plug connector, the plug connector is thus compressed axially (in the insertion direction) with cushioning provided by the resilient damping element and as a result its inner movability is restricted.

Preferably, the plug connector is provided with form- or force-locking connection means interacting with the mating plug connector, for example screws, clamping clips or similar which allow the mating plug connector to be drawn sufficiently close to the plug connector or pushed sufficiently far into the plug connector when being plugged in, compressing the damping element. In order to avoid an excessive compression of the damping element by the connection means, a corresponding limit stop can be provided on the plug connector.

It has thereby proved expedient that the resilient damping element is not in direct contact with a current-carrying element such as the inner conductor contact. Instead, when plugging in the mating plug connector the damping element should only apply pressure on the inner conductor contact in the insertion direction indirectly, so pressing this axially against the insulating part. For this purpose, an axially movable intermediate element made of a rigid material can be provided between the damping element and the inner conductor contact. On the other hand, it has proved particularly advantageous if the damping element applies pressure directly on the insulating part in the insertion direction. In a particularly preferred embodiment of the invention, through the compression of the damping element in the insertion direction, pressure is first applied to the inner conductor contact indirectly and, once a specified state of compression of the damping element has been reached, pressure is additionally applied, indirectly and/or directly, to the insulating part.

In order to make possible such a stepwise application of pressure, it has proved expedient for an axial material thickness of the damping element to be variable, wherein a section of greater material thickness is provided for the application of pressure on the inner conductor contact and a section of lesser material thickness for the application of pressure on the insulating part. In this case, during the plugging action pressure is only applied to the insulating part when the damping element has already been compressed by the difference between the section of greater material thickness and the section of lesser material thickness. This leads to a particularly stable and rigid overall arrangement of the plug connector and the mating plug connector connected with this. Preferably, the front surface of the damping element facing the mating plug connector has a convex-curved, in particular a rounded contour.

In the uncompressed state of the damping element, the plug connector according to the invention preferably has an axial play between the inner conductor contact and the insulating part and/or between the insulating part and the outer conductor part, wherein at least the play between the inner conductor contact and the insulating part, and preferably also the play between the insulating part and the outer conductor part can be reduced or eliminated through application of pressure on the damping element in the insertion direction. A structure of the plug connector allowing a degree of play allows a simpler and faster installation of the plug connector.

According to a particularly preferred embodiment of the invention, the damping element forms a front boundary surface of the plug connector which faces the mating plug connector when it is plugged in. In this case, when the mating plug connector is plugged in, a counter pressure surface of the mating plug connector can directly apply pressure to the damping element.

A damping element attached to the front of the plug connector and preferably exposed to the outside can also be attached to the plug connector following installation of the inner conductor contact and insulating part in the outer conductor housing. In particular, a retrofitting of conventional plug connectors may also be possible through attachment of the damping element. Preferably, the damping element forms the leading boundary surface of the plug connector during the plugging action.

In terms of achieving an evenly distributed application of pressure on the inner conductor contact and/or on the insulating part, it has proved advantageous if the damping element surrounds, in an annular manner, an insertion opening of the plug connector provided for insertion of a contact element of the mating plug connector. Preferably, the damping element is a soft rubber part or elastomer part of annular shape.

In order, when plugging in, to allow pressure to be applied reliably to the inner conductor contact arranged in the inside of the plug connector, it has proved expedient to provide a sliding element on the side of the damping element facing away from the mating plug connector when plugging in which is arranged so as to be axially displaceable along a guide of the plug connector and with an axial rear end which lies against the inner conductor contact. In this case, when the mating plug connector is plugged in, the damping element applies pressure on the inner conductor contact indirectly via the sliding element as intermediate element and forces the inner conductor contact in the direction of a contact surface of the insulating part.

The sliding element is preferably formed of a rigid, preferably at least in sections annular plastics body, on the front end of which the damping element, consisting of an elastomer or rubber material, is sprayed on.

Preferably, the insulating part has on its front side an at least in sections circular annular guide groove, the floor of which is formed by the inner conductor contact. The guide groove runs in a substantially axial direction, so that the sliding element can be accommodated therein in an axially displaceable manner, wherein it comes to rest against the inner conductor contact. The guide groove can have a holding mechanism, so that the sliding element is held axially displaceably in the guide groove and cannot fall out. The holding mechanism can be designed in the form of a snap-locking mechanism, wherein the sliding element can have a snap-locking projection and the guide groove a snap-locking recess or vice versa.

A second preferred embodiment of the invention is explained in the following. In this second embodiment, the resiliently compressible damping element is arranged between the insulating part and the outer conductor part. When the mating plug connector is plugged in, the insulating part is pressed in the direction of the outer conductor part, as a result of which the damping element is compressed in the insertion direction, and as a result the movability between the insulating part and the outer conductor part is restricted.

In terms of achieving an even application of pressure it has thereby proved expedient that the damping element has a substantially planar form and is arranged between a substantially flat contact surface of the outer conductor part and a counter pressure surface of the insulating part. In a sectional plane running transversely to the insertion direction, a substantially round contour of the damping element has proved particularly advantageous. A plug connector with more than one inner conductor contact can also have more than one damping element.

Damage to the insulating part through excessive application of pressure can be effectively prevented in that the dimension of the damping element is variable in the insertion direction S, wherein a central region of the damping element is thicker than an edge region of the damping element. This means that, when plugging in the mating plug connector, the central region is compressed first and only then, in addition, also the edge region of the damping element, so that the counter pressure effect exerted by the damping element increases during the course of the plugging action. This facilitates the measured application of a force necessary for connecting connecting-means such as screws which are provided in order to create the connection between the plug connector and the complementary mating plug connector.

According to the second embodiment, the plug connector according to the invention is preferably an angle connector, in which a main axis H of the inner conductor contact and/or of the insulating part runs transversely, in particular roughly perpendicular to the insertion direction, so that the current-carrying inner conductor can be led away transversely to the insertion direction of the mating plug connector. Preferably, the inner conductor contact has, on the one hand, a contact element for making contact with the mating contact element of the mating plug connector and on the other hand a rod-formed conductor part extending along the main axis H starting out from the contact element, which can be connected with the inner conductor of a coaxial cable.

The damping element preferably has, in the uncompressed state, a dimension in the insertion direction which is sufficiently large that the inner conductor contact and/or the insulating part is, at least in sections, deflected relative to the main axis by the damping element. Only through the plugging-in of the mating plug connector, with compression of the damping element, does the inner conductor contact and/or the insulating part return to an undeflected position in which the movability of the inner conductor contact and/or of the insulating part relative to the outer conductor part is restricted.

According to a further aspect, the invention relates to a plug connector arrangement comprising a plug connector according to the invention and a complementary mating plug connector which is configured such that when it is plugged into the plug connector the damping element of the plug connector is resiliently compressed and a movability of the insulating part relative to the inner conductor contact and/or relative to the outer conductor part is thereby reduced.

The invention is explained in the following description with reference to the attached drawings.

FIG. 1 shows a first embodiment of a plug connector according to the invention 10 in a longitudinal sectional view. The plug connector 10 consists of an inner conductor contact 20 which is surrounded by an insulating part 30 made of a non-conductive material such as plastic. The insulating part 30 prevents the inner conductor contact 20 from coming into electrical contact with an outer conductor part 40 of the plug connector 10.

The plug connector 10 is connected with a coaxial cable 70, wherein the shielding 71 of the coaxial cable 70 is coupled electrically with the outer conductor part 40 of the plug connector and the inner conductor 72 of the coaxial cable 70 is coupled electrically with the inner conductor contact 20 of the plug connector 10, for example by soldering or crimping.

Figure 2A:
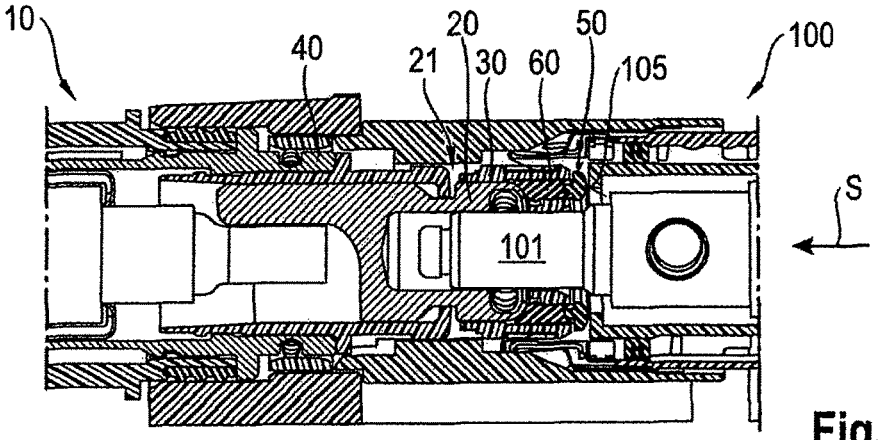
FIGS. 2*a* and 2*b* show a plugging action in which a mating plug connector is coupled in the insertion direction S with the plug connector shown in FIG. 1.
Figure 2B:
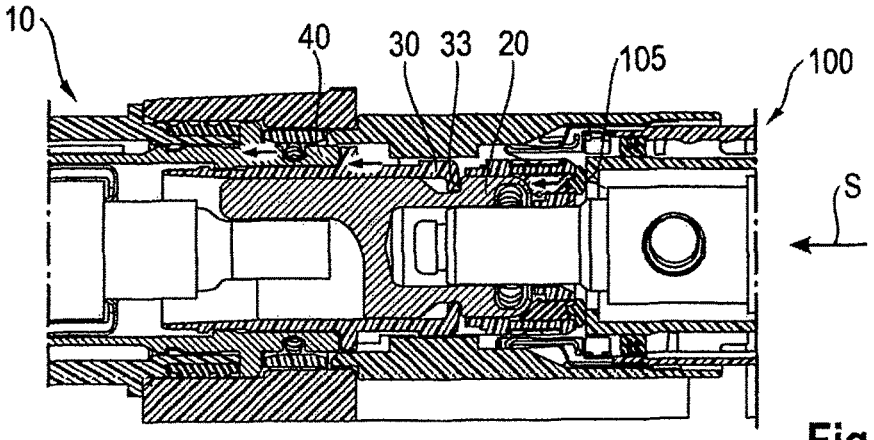

The inner conductor contact 20 is designed on the plug side as a socket with a contact spring into which a contact element 101 of a mating plug connector 100 in the form of a contact pin can be inserted in order to establish an electrical contact. FIGS. 2*a* and 2*b* show the entire plug connection consisting of plug connector 10 and mating plug connector 100 connected thereto.

During the assembly of the plug connector 10, the inner conductor contact 20 is first connected with the inner conductor 72 of the coaxial cable 70, for example by soldering. The inner conductor contact 20 is then pushed into the insulating part 30 until a projection on the insulating part 30 snaps into a recess 25 in the inner conductor contact 20. The axial dimension of the recess 25 is such that a relative movement between insulating part 30 and inner conductor contact 20 is possible within the extent of a specified axial play 21. This facilitates the attachment of the insulating part 30 to the inner conductor contact 20. The outer conductor part 40 of the plug connector 10 is then for example attached to this cable arrangement by pressing or crimping, so that the outer conductor part 40 makes electrical contact with the outer conductor 71 of the cable 70. The outer conductor part 40 is movable relative to the insulating part 30 within the extent of a specified axial play 22.

In conventional plug connectors, the axial plays 21, 22 still allow relative movements between the inner conductor contact 20, the insulating part 30 and the outer conductor part 40 even after coupling with the complementary mating plug connector, which results in an increased material wear, particularly if the plug connection is subjected to high mechanical stresses such as vibrations.

For this reason, the plug connector 10 according to the invention is provided with a resiliently compressible damping element 50. When pressure is applied in the insertion direction S on the damping element 50 this is compressed, as a result of which the movability of the inner conductor contact 20 relative to the insulating part 30 and/or the movability of the insulating part relative to the outer conductor part 40 is reduced or wholly eliminated. The final connected state with completely eliminated axial play 21, 22 is illustrated in FIG. 2*b*, whereas in FIG. 2*a* a position during the course of plugging-in of the mating plug connector 100 is illustrated in which, while the counter pressure surface 105 of the mating plug connector 100 already lies against the damping element 50 it has not yet completely compressed this.

In the embodiment illustrated in FIG. 1, the damping element 50 is provided on the plug connector 10 such that it transmits the pressure applied by the mating plug connector 100 when plugging in indirectly to the inner conductor contact 20 and directly to the insulating part 30. As a result, the inner conductor contact 20, the insulating part 30 and the outer conductor part 40 are pushed together during the course of the plugging action, so that the axial plays 21 and 22 are eliminated and a rigid and immovable connection between the inner conductor contact 20, the insulating part 30 and the outer conductor contact is established.

Figure 3A:
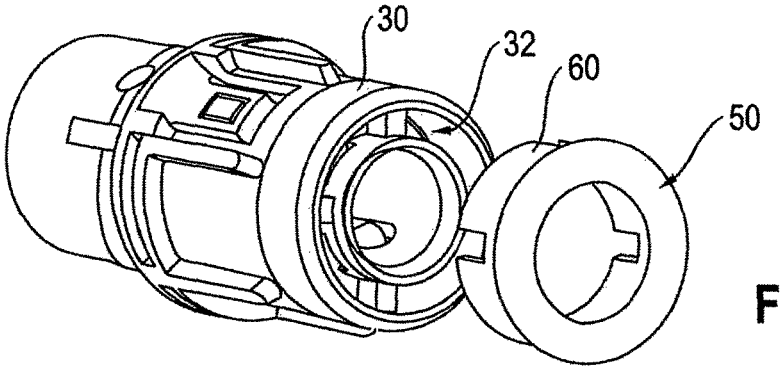
FIGS. 3*a* and 3*b* show the insulating part 30 of the plug connector shown in FIG. 1 together with the damping element 50 which can be attached thereto in a perspective view and in a longitudinal sectional view.
Figure 3B:
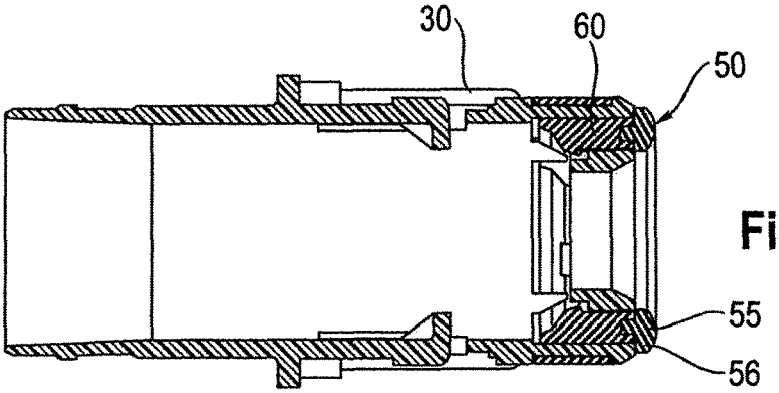

As illustrated particularly clearly in FIGS. 3*a* and 3*b*, the damping element 50 is sprayed, in substantially annular form, onto the front end of a rigid plastics body which forms a sliding element 60 which can be accommodated displaceably within a guide 32 of the insulating part 30. On application of pressure on the damping element 50 in the insertion direction S, the sliding element 60 attached thereto is pressed into the guide 32 and thereby displaces the inner conductor contact 20 resting thereon in the direction of a limit stop 33 of the insulating part 30.

When plugging in the mating plug connector, the damping element 50 forms the leading front surface of the plug connector to which pressure can be applied through the counter pressure surface 105 of the mating plug connector 100 shown in FIGS. 2*a* and 2*b*. The front surface of the damping element 50 is not flat, but forms a convex curve, so that during the course of the plugging action, a section 55 of high material density comes into contact with the counter pressure surface 105 and forces the sliding element 50 in the direction of the inner conductor contact 20. A section 56 of lower material density resting directly against the insulating part 30 then comes into contact with the counter pressure surface 105 and presses the insulating part in the direction of the outer conductor part 40. Alternatively or additionally, the insulating part 30 is pressed, indirectly via the inner conductor part 20, in the direction of a contact surface of the outer conductor part 40.

While at the beginning of the plugging action, axial plays 21 and 22 still exist between the inner conductor contact 20, the insulating part 30 and the outer conductor part 40 (see FIG. 2*a*), following completion of the plugging action, radially-oriented contact surfaces of the inner conductor contact 20, insulating part 30 and outer conductor part 40 lie in close contact with one another, without any play (see FIG. 2*b*).

In order to facilitate the plugging action and make possible an even more stable coupling, the plug connector 10 or the mating plug connector 100 can be provided with form- or force-locking connecting means such as screws, clips or clamps, by means of which, starting out from the position shown in FIG. 2*a*, the mating plug connector can be drawn into the position according to FIG. 2*b*. The connecting means also prevent an accidental disconnection of the plug connection.

Figure 4:
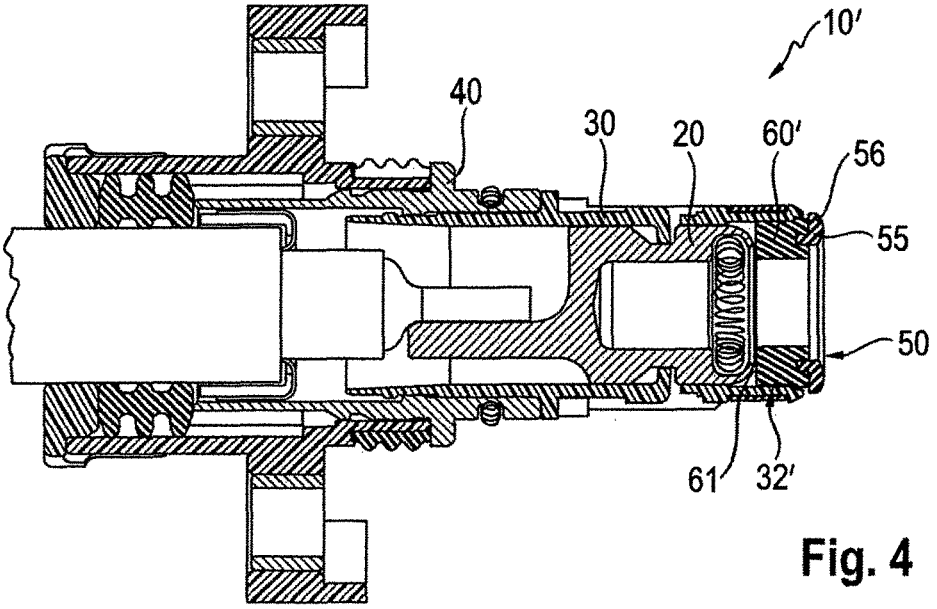
FIG. 4 shows an alternative embodiment of a plug connector according to the invention in a longitudinal sectional view.

FIG. 4 shows a slightly modified embodiment of a plug connector 10' according to the invention in which the sliding element 60', on the front end of which the damping element 50 is sprayed, is not held in an axially displaceable manner in a guide groove of the insulating part 30 but is held in a radial guide 32' which rests radially against the outside of the sliding element 60'. Here too, the rear end 61 of the sliding element 60' lies against the inner conductor contact 20, while the damping element 50, formed as a soft component, cannot come into direct electrical contact with a current-carrying part.

Figure 5:
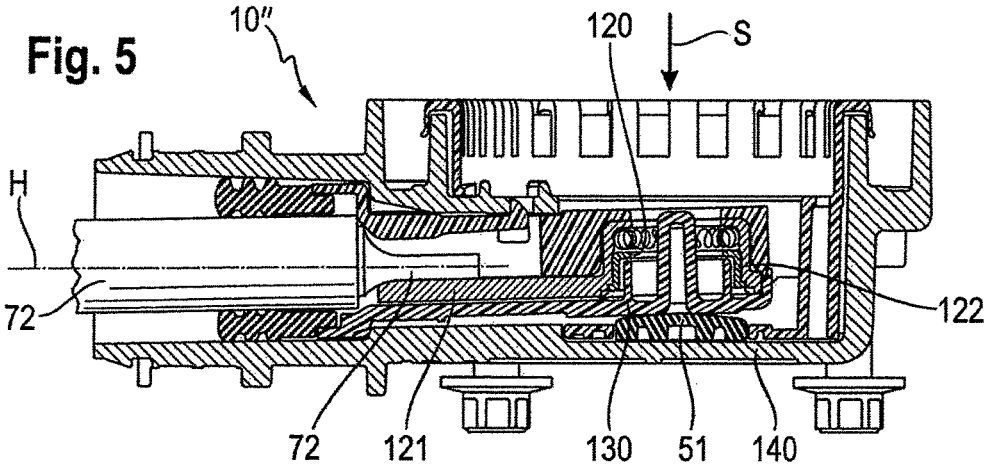
FIG. 5 shows a second embodiment of a plug connector according to the invention in a sectional view.
Figure 6A:
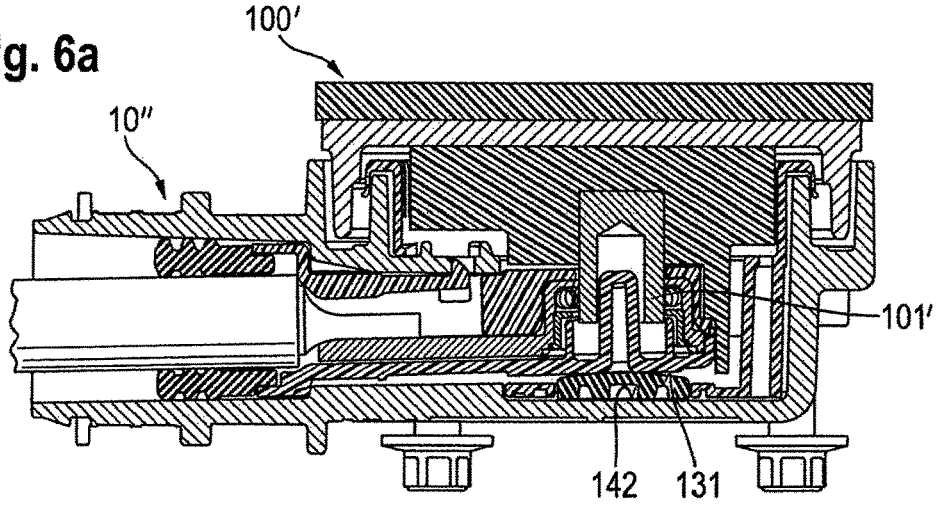
FIGS. 6*a* and 6*b* show a plugging action in which a mating plug connector is coupled in the insertion direction S with the plug connector shown in FIG. 5.
Figure 6B:
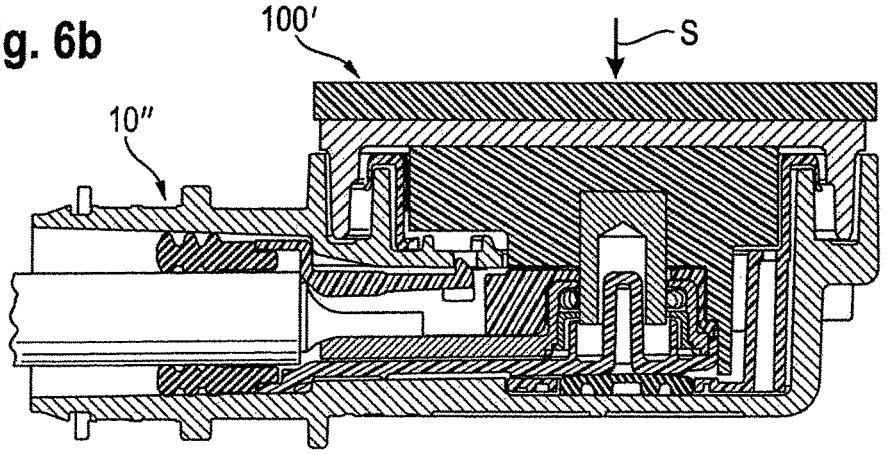

FIG. 5 shows a second embodiment of a plug connector 10" according to the invention. This plug connector is designed as an angle plug or angle socket in which the main axis H of the inner conductor contact 120 or of the insulating part 130 runs transversely, in particular perpendicular, to the insertion direction S. In this way, the inner conductor can be led away perpendicular to the insertion direction S. The inner conductor contact 120 of the second embodiment has, on the one hand, a contact element 122 with contact spring for making contact with one or more contact pins 101' of the mating plug connector 100' and on the other hand a rod-formed conductor part 121 extending along the main axis H, starting out from the contact element 122, which can be connected with the inner conductor 72 of the coaxial cable 70.

The contact element 122 of the inner conductor contact 120 is held by an insulating part 130 of a non-conductive material. The arrangement consisting of inner conductor contact 120 and insulating part 130 is accommodated in an outer conductor housing 140 which forms a shield.

Figure 7:
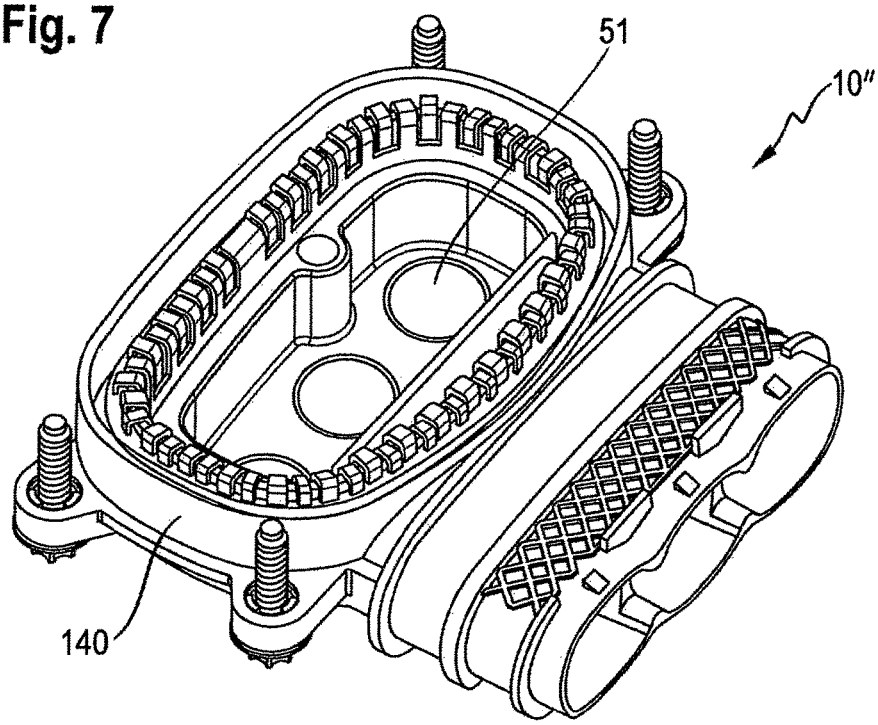
FIG. 7 shows a perspective view of the plug connector shown in FIG. 5 without insulating part and inner conductor contact.
Figure 8:
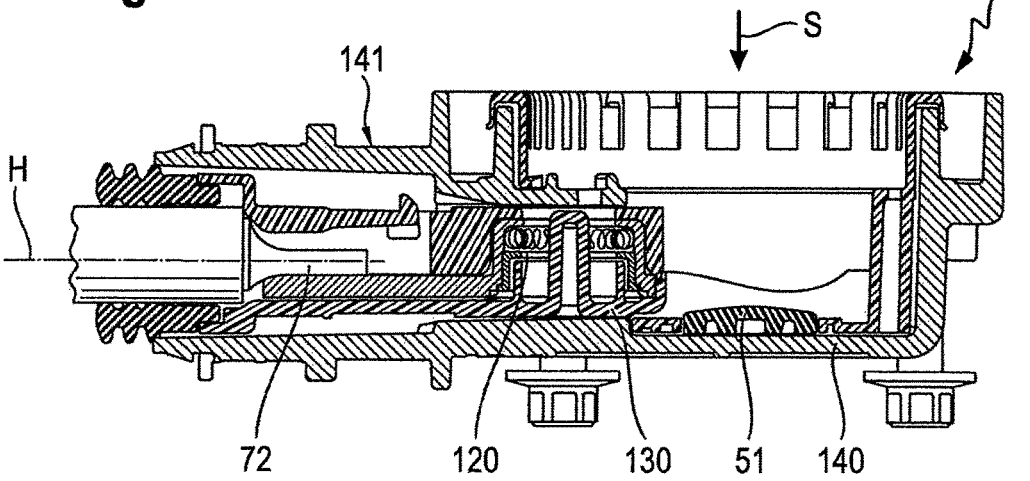
FIG. 8 shows an intermediate step in the assembly of the plug connector shown in FIG. 5.

As shown in FIG. 8, in order to manufacture the plug connector 10", the inner conductor contact 120 is first connected with the inner conductor 72 of the coaxial cable, then the insulating part 130 is attached to the inner conductor contact 120. The arrangement consisting of insulating part 130 and inner conductor contact 120 is introduced along the main axis H, which runs perpendicular to the insertion direction S, into a tubular section 141 of the outer conductor part 140 (see FIG. 8). A damping element 51 in the form of a resiliently compressible soft component is arranged on a substantially flat rear wall of the outer conductor part 140. As shown in FIG. 7, the plug connector can also have more than one, for example two or three damping elements 51. The damping element 51 is substantially disc-formed and has a central section with a larger dimension in the insertion direction S than the edge sections of the damping element 51. In other words, a convexity of the damping element 51 projects into an installation space of the outer conductor part 140 intended for accommodation of the insulating part 130.

If the arrangement consisting of inner conductor contact 120 and insulating part 130 is pushed from the position shown in FIG. 8 into the position shown in FIG. 5, the front end of the insulating part 130 and the front end of the inner conductor contact 120 are deflected contrary to the insertion direction S by the damping element 51 projecting into the installation space. The damping element is then arranged between a flat contact surface 142 of the outer conductor part 140 and a counter pressure surface 131 of the insulating part on the side of the insulating part 130 facing away from the inner conductor contact 120. In this position, the front ends of inner conductor contact 120 and insulating part 130 are movable relative to the outer conductor part 140 in the insertion direction S.

On plugging of the complementary mating plug connector 100' in the insertion direction S, this movability is restricted in that the insulating part 130 is pressed, under the pressure exerted through the mating plug connector 100', against the bias of the damping element 51, in a cushioned manner, in the direction of the contact surface 142 of the outer conductor part. The damping element 51 is thereby initially only slightly compressed (see FIG. 6*a*). Only in the last part of the plugging action, i.e., when the outer conductor part 140 of the plug connector is screwed together with the mating plug connector 100', is the damping element 51 tightly compressed and in consequence the deflection of the inner conductor contact 120 and of the insulating part 130 relative to the main axis H reversed. In the connection position shown in FIG. 6*b*, the insulating part 130 is arranged substantially immovably relative to the outer conductor part 140. In this connection position, powerful vibrations are dampened through the damping element 51, as a result of which wear on the insulating part 130 and outer conductor part 140 is reliably minimized.

The two explicitly explained embodiments of the present invention are simply exemplary. For example, the damping element 50, 51 is not necessarily annular in form or disc-formed. Also, a plug connector can have more than one damping element, depending on the size and number of the inner conductor contacts. What is important, according to the invention, is that the damping element is provided on the plug connector such that it is only resiliently compressed when the plug connector is plugged together with the mating plug connector, and a movability between the insulating part, the inner conductor contact and the outer conductor part which leads to wear is thus only eliminated on formation of the final plug connection.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector, comprising an inner conductor contact for carrying current, an outer conductor part and an insulating part which keeps the inner conductor contact spaced apart from the outer conductor part, wherein a resiliently compressible damping element is provided on the plug connector such that, when a complementary mating plug connector is plugged into the plug connector in an insertion direction (S), it is resiliently compressible, such that, when the mating plug connector is plugged in, the damping element directly or indirectly applies pressure in the insertion direction (S) on the inner conductor contact and/or on the insulating part and thereby reduces a movability of the insulating part relative to the inner conductor contact and/or relative to the outer conductor part, wherein the axial material thickness of the damping element is variable, and wherein a section of greater material thickness is provided for the application of pressure on the inner conductor contact and a section of lesser material thickness for the application of pressure on the insulating part.

2. The plug connector of claim 1, wherein when the mating plug connector is plugged in, the damping element indirectly applies pressure in the insertion direction (S) on the inner conductor contact and directly applies pressure in the insertion direction (S) on the insulating part.

3. The plug connector of claim 1 including axial play between the inner conductor contact and the insulating part and/or between the insulating part and the outer conductor part, wherein at least the play between the inner conductor contact and the insulating part and also the play between the insulating part and the outer conductor part can be reduced or eliminated through application of pressure on the damping element in the insertion direction (S).

4. The plug connector, comprising an inner conductor contact for carrying current, an outer conductor part and an insulating part which keeps the inner conductor contact spaced apart from the outer conductor part, wherein a resiliently compressible damping element is provided on the plug connector such that, when a complementary mating plug connector is plugged into the plug connector in an insertion direction (S), it is resiliently compressible, such that, when the mating plug connector is plugged in, the damping element directly or indirectly applies pressure in the insertion direction (S) on the inner conductor contact and/or on the insulating part and thereby reduces a movability of the insulating part relative to the inner conductor contact and/or relative to the outer conductor part, wherein the damping element forms a front boundary surface of the plug connector which faces the mating plug connector when the latter is plugged in.

5. The plug connector of claim 4, wherein the damping element surrounds, in an annular manner, an insertion opening of the plug connector provided for insertion of a contact element of the mating plug connector.

6. A plug connector, comprising an inner conductor contact for carrying current, an outer conductor part and an insulating part which keeps the inner conductor contact spaced apart from the outer conductor part, wherein a resiliently compressible damping element is provided on the plug connector such that, when a complementary mating plug connector is plugged into the plug connector in an insertion direction (S), it is resiliently compressible, such that, when the mating plug connector is plugged in, the damping element directly or indirectly applies pressure in the insertion direction (S) on the inner conductor contact and/or on the insulating part and thereby reduces a movability of the insulating part relative to the inner conductor contact and/or relative to the outer conductor part, said plug connector including a sliding element on the side of the damping element facing away from the mating plug connector when plugging in which is arranged so as to be axially displaceable along a guide of the plug connector and with a rear axial end which lies against the inner conductor contact.

7. The plug connector of claim 6, wherein the sliding element is formed of a rigid, preferably at least in sections annular plastics body, on the front end of which the damping element is sprayed on.

8. The plug connector of claim 6, wherein the sliding element is, at least in sections, arranged in an at least in sections circular annular guide groove of the insulating part, the floor of which is formed by the inner conductor contact.

9. A plug connector, comprising an inner conductor contact for carrying current, an outer conductor part and an insulating part which keeps the inner conductor contact spaced apart from the outer conductor part, wherein a resiliently compressible damping element is provided on the plug connector such that, when a complementary mating plug connector is plugged into the plug connector in an insertion direction (S), it is resiliently compressible, such that, when the mating plug connector is plugged in, the damping element directly or indirectly applies pressure in the insertion direction (S) on the inner conductor contact and/or on the insulating part and thereby reduces a movability of the insulating part relative to the inner conductor contact and/or relative to the outer conductor part, wherein the resiliently compressible damping element is arranged between the insulating part and the outer conductor part, and when plugging in the mating plug connector is compressible in that the insulating part is pressed in the direction of the outer conductor part.

10. The plug connector of claim 9, wherein the damping element has a substantially planar form with preferably roughly round contour and acts between a substantially flat contact surface of the outer conductor part and a counter pressure surface of the insulating part.

11. The plug connector of claim 9, wherein the dimension of the damping element in the insertion direction (S) is variable, wherein a central region of the damping element is thicker than an edge region of the damping element.

12. The plug connector of claim 9, wherein the plug connector is an angle connector, in which a main axis (H) of the inner conductor contact and/or of the insulating part runs transversely, approximately perpendicular to the insertion direction (S), wherein the inner conductor contact and/or the insulating part is, at least in sections, deflected at least in sections relative to the main axis (H) by the damping element and can be deflected back through the plugging-in of the mating plug connector with compression of the damping element.

13. A plug connector arrangement with a plug connector comprising: an inner conductor contact for carrying current, an outer conductor part and an insulating part which keeps the inner conductor contact spaced apart from the outer conductor part, wherein a resiliently compressible damping element is provided on the plug connector such that, when a complementary mating plug connector is plugged into the plug connector in an insertion direction (S), it is resiliently compressible, such that, when the mating plug connector is plugged in, the damping element directly or indirectly applies pressure in the insertion direction (S) on the inner conductor contact and/or on the insulating part and thereby reduces a movability of the insulating part relative to the inner conductor contact and/or relative to the outer conductor part; and a complementary mating plug connector configured such that when said complementary mating plug connector is plugged into the plug connector the damping element of the plug connector is compressed and a movability of the insulating part relative to the inner conductor contact and/or relative to the outer conductor part is thereby reduced.

14. The plug connector of claim 1, wherein said plug connector is designed for high current applications.

15. The plug connector of claim 2 including axial play between the inner conductor contact and the insulating part and/or between the insulating part and the outer conductor part, wherein at least the play between the inner conductor contact and the insulating part and also the play between the insulating part and the outer conductor part can be reduced or eliminated through application of pressure on the damping element in the insertion direction (S).

16. The plug connector of claim 15, wherein the axial material thickness of the damping element is variable, and wherein a section of greater material thickness is provided for the application of pressure on the inner conductor contact and a section of lesser material thickness for the application of pressure on the insulating part.

17. The plug connector of claim 1, wherein the damping element forms a front boundary surface of the plug connector which faces the mating plug connector when the latter is plugged in.

18. The plug connector of claim 17 including a sliding element on the side of the damping element facing away from the mating plug connector when plugging in which is arranged so as to be axially displaceable along a guide of the plug connector and with a rear axial end which lies against the inner conductor contact.

19. The plug connector of claim 7, wherein the sliding element is, at least in sections, arranged in an at least in sections circular annular guide groove of the insulating part, the floor of which is formed by the inner conductor contact.

20. The plug connector of claim 10, wherein the dimension of the damping element in the insertion direction (S) is variable, wherein a central region of the damping element is thicker that an edge region of the damping element.

* * * * *